US009516403B2

(12) United States Patent
Huang

(10) Patent No.: US 9,516,403 B2
(45) Date of Patent: Dec. 6, 2016

(54) EARPHONE WITH STAND-ALONE HIGH-FREQUENCY DRIVER

(71) Applicant: Jetvox Acoustic Corp., Taoyuan (TW)

(72) Inventor: To-Teng Huang, Taoyuan (TW)

(73) Assignee: JETVOX ACOUSTIC CORP., Taoyuan (TW)

( * ) Notice: Subject to any disclaimer, the term of this patent is extended or adjusted under 35 U.S.C. 154(b) by 0 days.

(21) Appl. No.: 14/742,157

(22) Filed: Jun. 17, 2015

(65) Prior Publication Data

US 2016/0316289 A1 Oct. 27, 2016

(30) Foreign Application Priority Data

Apr. 24, 2015 (TW) ..... 104206345 U

(51) Int. Cl.

| | |
|---|---|
| ***H04R 25/00*** | (2006.01) |
| ***H04R 1/10*** | (2006.01) |
| ***H04R 1/28*** | (2006.01) |
| ***H04R 1/26*** | (2006.01) |

(52) U.S. Cl.

CPC ..... *H04R 1/1016* (2013.01); *H04R 1/1075* (2013.01); *H04R 1/26* (2013.01); *H04R 1/28* (2013.01); *H04R 25/604* (2013.01); *H04R 2201/10* (2013.01); *H04R 2205/022* (2013.01)

(58) Field of Classification Search

CPC ... H04R 1/1008; H04R 1/1016; H04R 1/1075; H04R 1/26; H04R 5/033; H04R 11/02; H04R 2525/48; H04R 25/604; H04R 9/063; H04R 2209/026; H04R 2225/025; H04R 25/48; H04R 1/10; H04R 2201/10

USPC ..... 381/309, 324, 328, 182, 370, 380, 418; 181/129, 130, 135

See application file for complete search history.

(56) References Cited

U.S. PATENT DOCUMENTS

| | | | | |
|---|---|---|---|---|
| 4,965,836 A * | 10/1990 | Andre | H04R 1/1008 181/129 |
| 2014/0140565 A1* | 5/2014 | Liu | H04R 1/1091 381/380 |
| 2014/0205131 A1* | 7/2014 | Azmi | H04R 1/1075 381/380 |

* cited by examiner

*Primary Examiner* — Huyen D Le

(74) *Attorney, Agent, or Firm* — Muncy, Geissler, Olds & Lowe, P.C.

(57) ABSTRACT

An earphone with stand-alone high-frequency driver includes a casing, a low-frequency driver, a high-frequency driver, and a protecting cover. The casing defines a sound-guiding passage and a separating wall. The separating wall is formed on a side surface of the sound-guiding passage and defines a sound port, which is in communication with the sound-guiding passage. The high-frequency driver is disposed next to the separating wall and defines a sound-outputting direction. The protecting cover is mated to the casing and covers the high-frequency driver. The sound waves generated by both low- and high-frequency drivers are delivered externally through the sound-guiding passage. The earphone allows structural modifications and assembling the high-frequency driver and the protecting cover after a half-finished product (casing and low-frequency driver) is obtained. Hence, no major modification of the manufacturing processes is necessary, thus shortening the manufacturing time, lowering the manufacturing costs, and avoiding delay in product delivery.

10 Claims, 6 Drawing Sheets

EARPHONE WITH STAND-ALONE HIGH-FREQUENCY DRIVER

CROSS-REFERENCES TO RELATED APPLICATIONS

This non-provisional application claims priority under 35 U.S.C. §119(a) on Patent Application No. 104206345 filed in Taiwan, R.O.C. on 2015 Apr. 24, the entire contents of which are hereby incorporated by reference.

BACKGROUND

1. Technical Field

The instant disclosure relates to the field of earphones, in particular, to an earphone having high-frequency driver externally of the earphone casing.

2. Related Art

With the advancement in consumer electronics and increasing need for earphones, there is a growing demand for earphones with better qualities and in large quantities. Currently, earphones with only one single driver for a full-range of frequencies have been the norm due to its advantages in well-established technology and fast manufacturing. The single driver configuration is excellent for reproducing low and middle frequency sounds, however, it works less ideal in high frequency range. To address this issue, the most common remedial action is to install a high frequency driver.

To utilize the high frequency driver, the earphone casing is usually modified structurally to provide extra mounting space, such that the low frequency driver as well as the high frequency driver can both be installed. For dual drivers, a balanced audio output and resolution must be taken into consideration. If the audio resolution is not satisfactory, the earphone has to be modified structurally accompanied with remolding and retesting. In consumer markets, earphones are often sold along with consumer electronics, and production lines of manufacturing facilities are normally used to produce several different products. Any change in the structural configuration of earphones or its assembling process could alter the manufacturing processes, induce lower yield rate, or delay product delivery. These issues could create a bad impression for consumers or clients.

SUMMARY

The objective of the instant disclosure is to provide an earphone having a stand-alone type high-frequency driver. The earphone comprises a casing; a low-frequency driver; a high-frequency driver; and a protecting cover. The casing defines a sound-guiding passage and a separating wall, which is formed on a side surface of the sound-guiding passage. The separating wall further defines a sound port in acoustic communication with the sound-guiding passage. The low-frequency driver is disposed inside the casing to generate low-frequency sound waves. The low-frequency sound waves are delivered externally through the sound-guiding passage. The high-frequency driver is disposed next to the separating wall and defines a sound-outputting direction in correspondence to the sound port. The protecting cover is mated to the casing and covers the high-frequency driver.

In one embodiment, the sound-guiding passage further defines an axial direction that forms an acute angle θ with the sound-outputting direction. The acute angle θ ranges from 0° to 90°, with a preferable range of 15° to 85°, or more preferably from 30° to 60°.

In another embodiment, the casing includes a front shell and a rear shell assembled to each other. The protecting cover engages the front and rear shells, and the rear shell defines a via hole so that the high-frequency driver can be connected electrically to a circuit board through the via hole. The low-frequency driver is also connected electrically to the circuit board, and the via hole is covered by the protecting cover.

In yet another embodiment, the earphone comprises the casing; the low-frequency driver; the high-frequency driver; and the protecting cover. The casing has a sound-guiding portion and a separating wall, with the separating wall disposed on a side surface of the sound-guiding portion. The low-frequency driver is disposed inside the casing to generate low-frequency sound waves, and these low-frequency sound waves are delivered externally through the sound-guiding portion. The high-frequency driver is disposed next to the separating wall to generate high-frequency sound waves. The protecting cover is mated to the casing to cover the high-frequency driver. The protecting cover has a sound-outputting portion, and the sound-outputting portion defines a first axial direction, which is parallel to a second axial direction defined by the sound-guiding portion. The high-frequency sound waves are delivered externally by the sound-outputting portion.

In still yet another embodiment, the sound-guiding and outputting portions are arranged in a side-by-side manner to jointly provide a tubular structure. A rubber cap is further mated to the casing and the protecting cover by fitting over the tubular structure.

The earphone of the instant disclosure allows modifying existing earphones having single driver with ease. Another benefit is that the high-frequency driver and protecting cover can be assembled after a half-finished product (casing and low-frequency driver) is obtained. Hence, when a structural modification of the earphone must be made, the existing production lines can still be used without incurring significant modification of the manufacturing processes. Thus, the production time of modified earphones can be shortened and the manufacturing costs can be lowered, as well as avoiding delay in product delivery.

DETAILED DESCRIPTION

Figure 1:
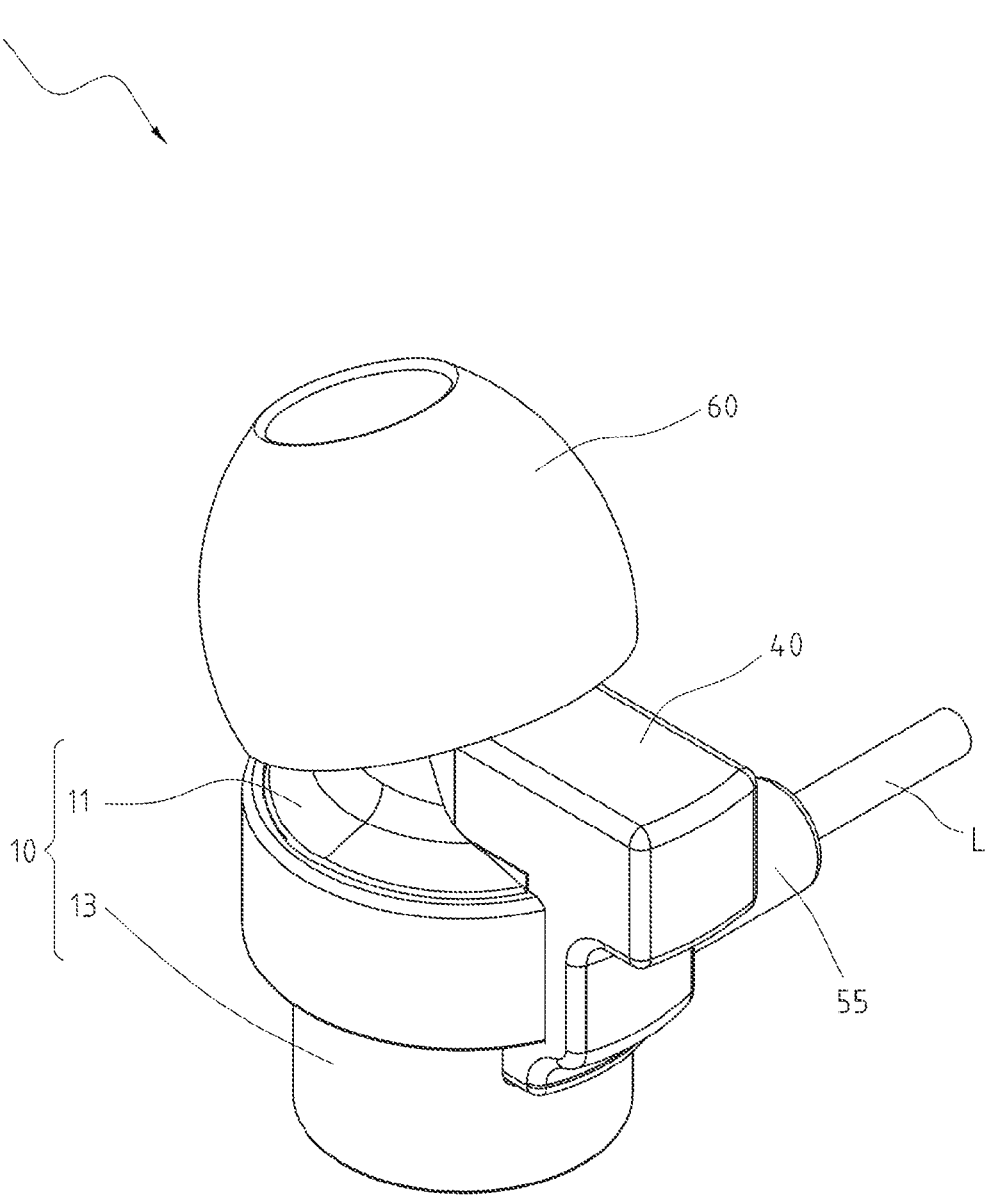
FIG. 1 is an earphone with stand-alone high-frequency driver for a first embodiment of the instant disclosure.
Figure 2:
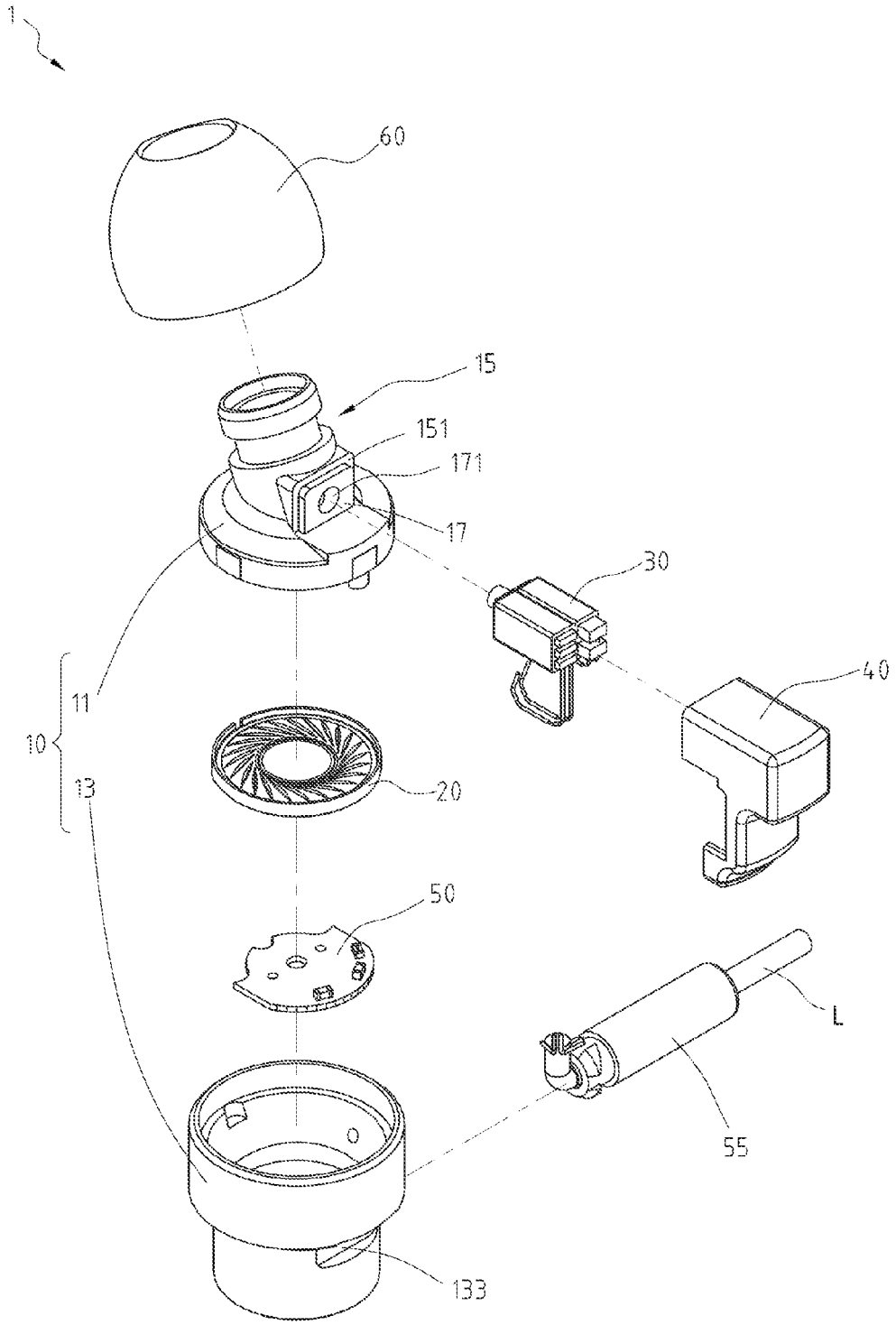
FIG. 2 is an exploded view of FIG. 1.
Figure 3:
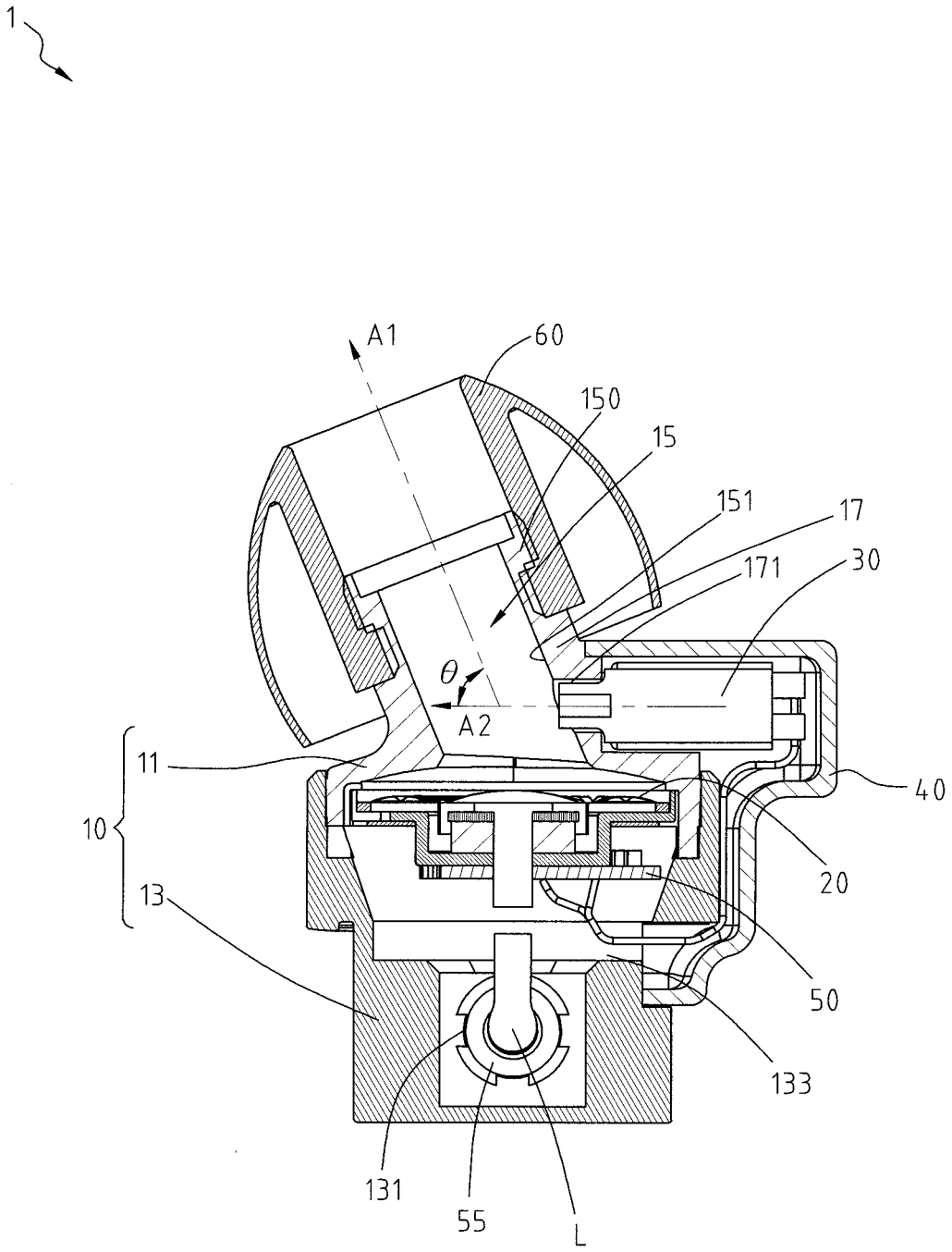
FIG. 3 is a cross-sectional view of FIG. 1.

Please refer to FIGS. 1-3, which show a perspective view, an exploded view, and a cross-sectional view, respectively, of an earphone with stand-alone high frequency driver for a first embodiment of the instant disclosure. As depicted in FIGS. 1-3, an earphone 1 comprises a casing 10, a low-frequency driver 20, a high-frequency driver 30, and a protecting cover 40. The casing 10 includes a front shell 11 and a rear shell 13 assembled to each other. The front shell 11 is formed with a sound-guiding passage 15 and a separating wall 17. The FIG. 3 illustrates the sound-guiding passage 15 is defined inside a tubular structure 150. The separating wall 17 is formed on a side surface 151 defined by the sound-guiding passage 15. A sound port 171 is further formed on the separating wall 17 and in acoustic communication with the sound-guiding passage 15. The rear shell 13 is formed with an access opening 131 and a via hole 133.

The low-frequency driver 20 is disposed in between the front and rear shells 11 and 13, whereas the high-frequency driver 30 is disposed externally of the casing 10, in particular on one side of the separating wall 17 and separated from the low-frequency driver 20 by the separating wall 17. The low-frequency driver 20 is connected electrically to a circuit board 50, while the high-frequency driver 30 is wired to the circuit board 50 through the via hole 133. The high-frequency driver 30 defines a sound-outputting direction A2 that corresponds to the sound port 171, while the sound-guiding passage 15 defines an axial direction A1 that forms an acute angle θ with the sound-outputting direction A2. The defined acute angle θ can range from 0° to 90° with a preferable range of 15° to 85°, or more preferably from 30° to 60°. The high-frequency sound waves generated by the high-frequency driver 30 are passed to the sound-guiding passage 15 via the sound port 171 to be mixed with the low-frequency sound waves generated by the low-frequency driver 20. In turn, the mixing of the high- and low-frequency sound waves is outputted externally through the sound-guiding passage 15.

The protecting cover 40 may be detachably assembled to the casing 10. For example, the protecting cover 40 can be concavedly shaped for securing to the outer edges of the front and rear shells 11 and 13 on one side of the casing 10. In particular, the concaved portion of the protecting cover 40 covers the high-frequency driver 30. In other words, the high-frequency driver 30 is held alone inside of a chamber-like structure. The protecting cover 40 also covers the via hole 133.

Furthermore, the shoulder that defines the via hole 133 are in contact with a tube-like holding member 55. An audio signal wire L passes through the holding member 55 to be in connection with the circuit board 50 and is secured within the holding member 55. The front shell 11 is further mated to a rubber cap 60, which is fitted over the sound-guiding passage 15.

Figure 4:
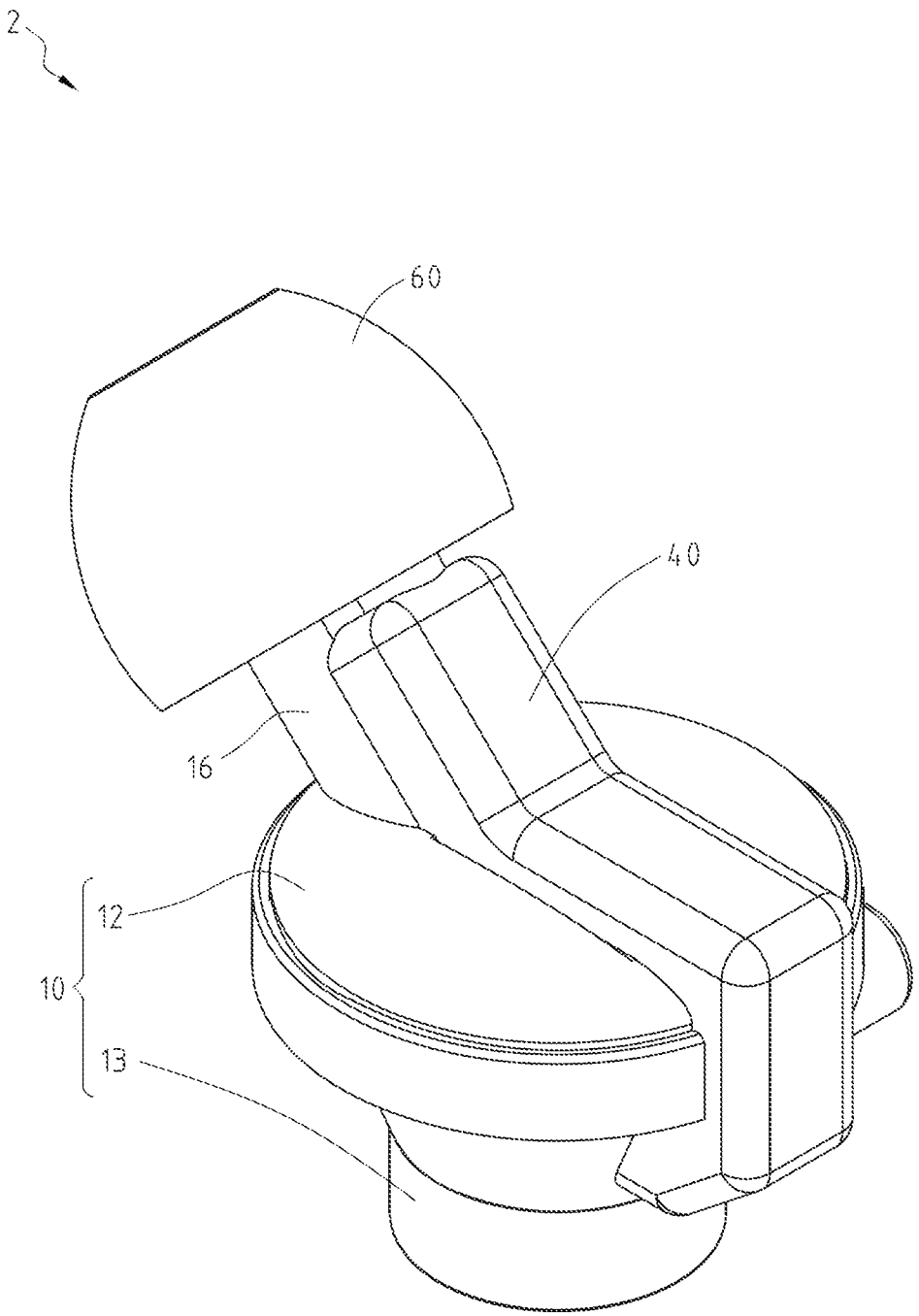
FIG. 4 is an earphone with stand-alone high-frequency driver for a second embodiment of the instant disclosure.
Figure 5:
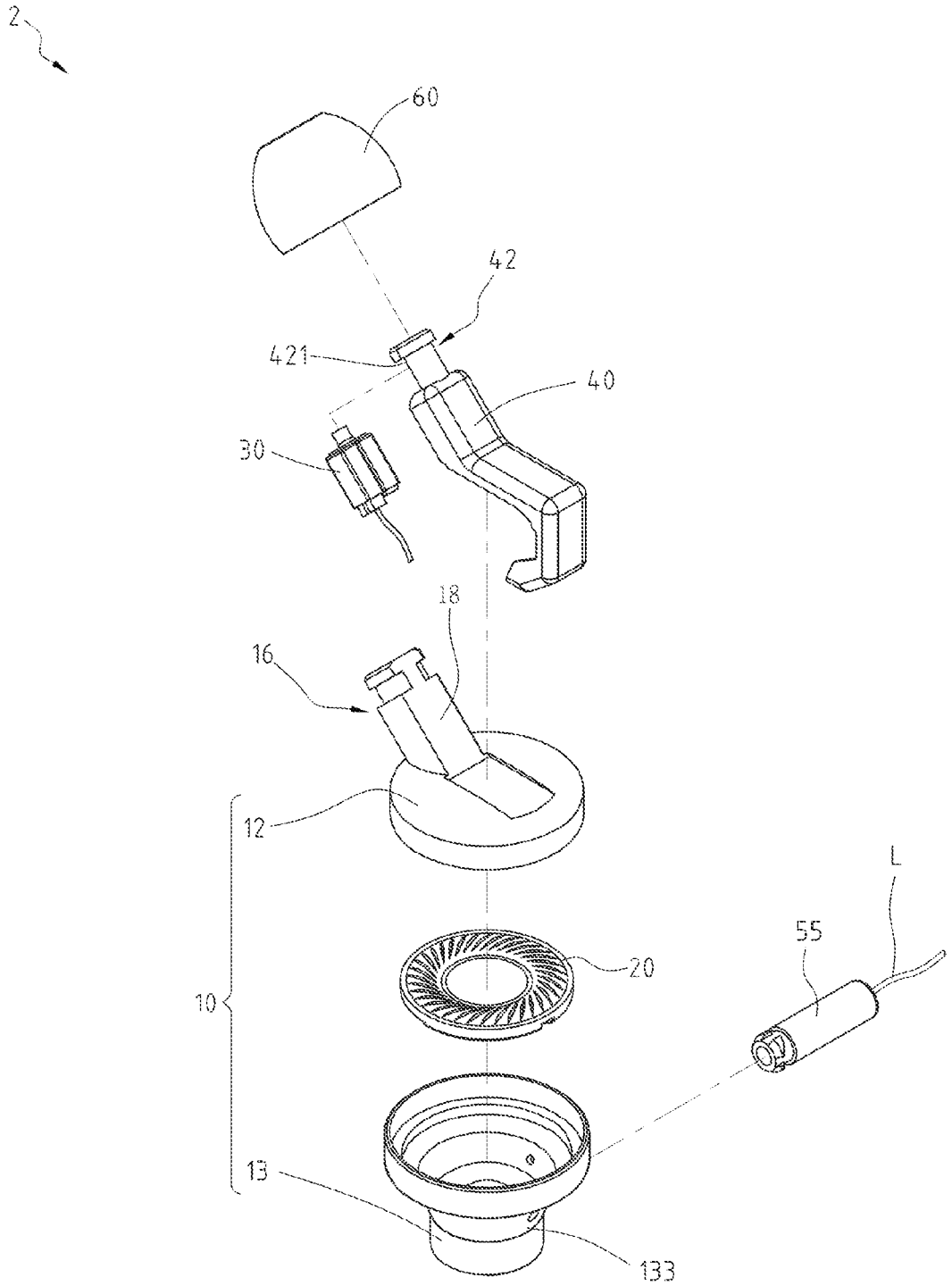
FIG. 5 is an exploded view of FIG. 4.
Figure 6:
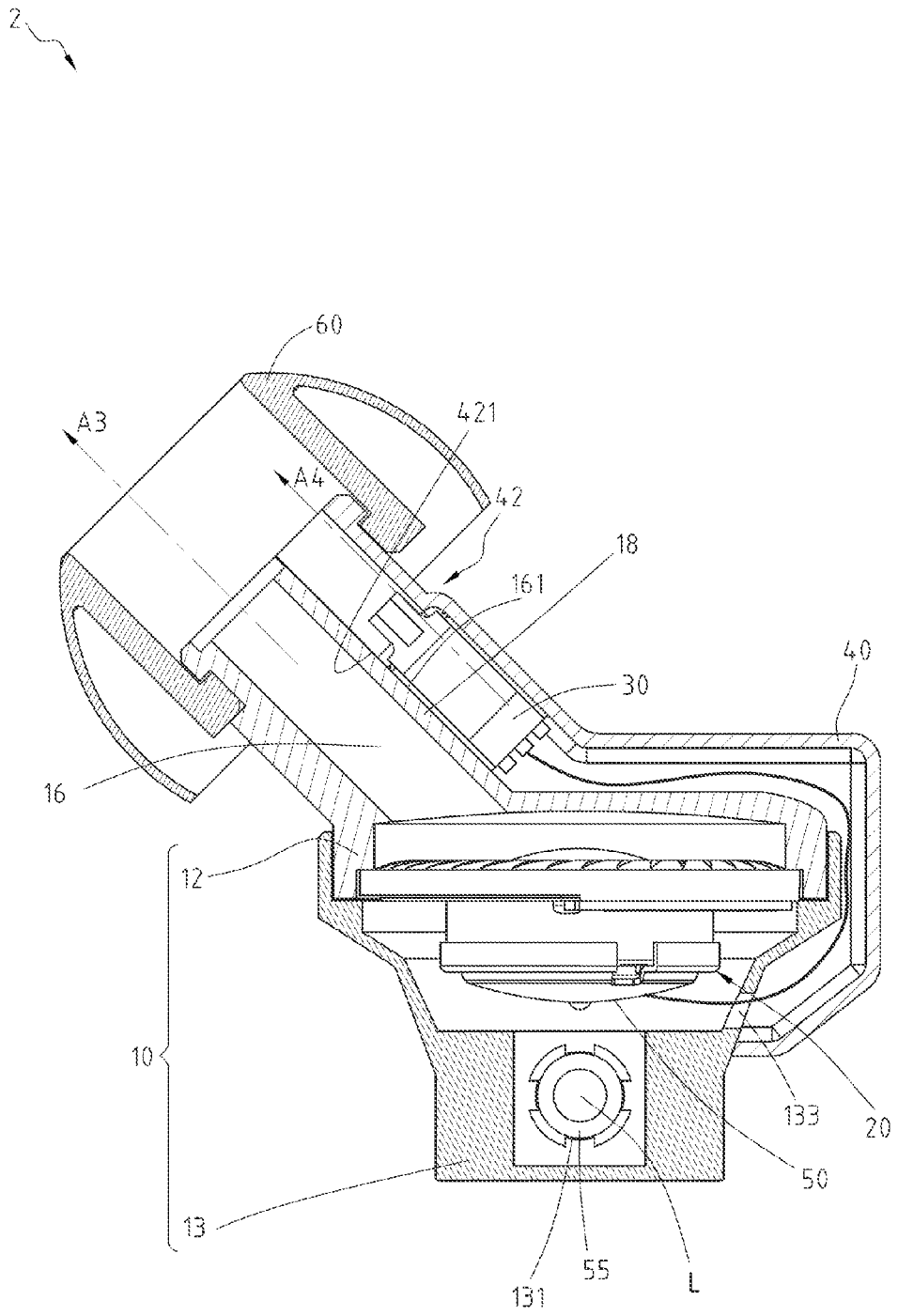
FIG. 6 is a cross-sectional view of FIG. 4.

Turning to FIGS. 4-6, which are a perspective, an exploded, and a cross-section view, respectively, of an earphone 2 with stand-alone high-frequency driver for a second embodiment of the instant disclosure. As shown in FIGS. 4-6, the earphone 2 comprises the casing 10, low-frequency driver 20, high-frequency driver 30, and protecting cover 40 that corresponds to the features provided in the previous embodiment. The major differences being the shape of the casing 10, the manner in which high-frequency driver 30 is disposed, and the shape of the protecting cover 40.

For the second embodiment, the casing 10 includes a front shell 12 and the rear shell 13. In addition, since the connecting relationships between the rear shell 13, the low-frequency driver 20, and the circuit board 50 have already been described in the first embodiment, no further discussion is necessary. Only the differences between the two embodiments will be discussed in greater detail below.

The front shell 12 has a sound-guiding portion 16 and a separating wall 18. The separating wall 18 is disposed on a side surface 161 of the sound-guiding portion 16. The high-frequency driver 30 is disposed beyond the separating wall 18 such that the high-frequency driver 30 is separated from the low-frequency driver 20 by the separating wall 18. The low-frequency sound waves generated by the low-frequency driver 20 are delivered externally via the sound-guiding portion 16.

The protecting cover 40 can be detachably assembled to the casing 10. For the second embodiment, besides having a concaved shape, the protecting cover 40 further has a sound-outputting portion 42, which has a wall surface 421. The wall surface 421 is abutted against the separating wall 18. In operation, the high-frequency sound waves generated by the high-frequency driver 30 are delivered externally via the sound-outputting portion 42 without mixing with the low-frequency sound waves. In addition, the sound-outputting portion 42 defines a first axial direction A4, which is parallel to a second axial direction A3 defined by the sound-guiding portion 16.

Please note the sound-guiding portion 16 and the sound-outputting portion 42 are arranged in a side-by-side fashion. Thereby, both elements togetherly define a tubular structure such as the sound-guiding passage 15 of the first embodiment. In addition, the casing 10 and the protecting cover 40 are mated to the rubber cap 60. The rubber cap 60 is installed over the aforementioned tubular structure. Such configuration further fixes the sound-outputting portion 42 and the sound-guiding portion 16 to each other to prevent separation.

It should be understood that in the first and second embodiments, the high-frequency driver 30 can be of the balance-armature (BA) type, dynamic type (i.e., moving coil or moving magnet), or piezoelectric type. The low-frequency driver 20 may be either of the moving-coil or moving-magnet type.

One advantage of the earphone of the instant disclosure is it allows an earphone with only a single driver to undergo structural modification with ease. The other attribute is that after a half-finished product is obtained having the earphone casing and the low-frequency driver, the high-frequency driver and the protecting cover may be assembled thereto afterwards. Thus, if there is a change in the structural configuration of the earphone, the existing production lines may still be usable without implementing major process changes, remolding, and retesting. The resulting impacts include shortening the manufacturing time, reducing manufacturing cost, and avoiding delay in product delivery due to process changes.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. An earphone with stand-alone high-frequency driver, comprising:

a casing defining a sound-guiding passage and a separating wall, the separating wall being formed on a side surface of the sound-guiding passage, the separating wall defining a sound port in communication with the sound-guiding passage, wherein the sound-guiding passage is defined inside a tubular structure;

a low-frequency driver disposed in the casing for generating low-frequency sound waves, the low-frequency sound waves being delivered externally via the sound-guiding passage;

a high-frequency driver disposed next to the separating wall, the high-frequency driver defining a sound-outputting direction corresponding to the sound port; and a protecting cover mated to the casing to cover the high-frequency driver.

2. The earphone of claim 1, wherein the sound-guiding passage defines an axial direction that forms an acute angle with the sound-outputting direction, and wherein the acute angle ranges from 0° to 90°.

3. The earphone of claim 2, wherein the acute angle ranges from 15° to 85°.

4. The earphone of claim 3, wherein the acute angle ranges from 30° to 60°.

5. The earphone of claim 1, wherein the high-frequency driver is a balanced-armature type, a moving-coil type, a moving-magnet type, or a piezoelectric type.

6. The earphone of claim 1, wherein the casing includes a front shell and a rear shell assembled to each other, with the front shell defining the sound-guiding passage, wherein the protecting cover is secured to the front and rear shells and the rear shell defines a via hole, so that the high-frequency driver is connected electrically to a circuit board through the via hole, and wherein the low-frequency driver is also connected electrically to the circuit board, with the via hole covered by the protecting cover.

7. An earphone with stand-alone high-frequency driver, comprising:

a casing having a sound-guiding portion and a separating wall, the separating wall being formed on a side surface of the sound-guiding portion;

a low-frequency driver disposed in the casing for generating low-frequency sound waves, the low-frequency sound waves being delivered via by the sound-guiding portion;

a high-frequency driver disposed next to the separating wall for generating high-frequency sound waves; and a protecting cover mated to the casing to cover the high-frequency driver, the protecting cover having a sound-outputting portion, the sound-outputting portion defining a first axial direction parallel with a second axial direction defined by the sound-guiding portion, the high-frequency sound waves being delivered externally via the sound-outputting portion, wherein the sound-guiding portion and sound-outputting portion are arranged in adjacent and side-by-side relationship to jointly define a tubular structure.

8. The earphone of claim 7, wherein a rubber cap is mated to the casing and the protecting cover by fitting over the tubular structure.

9. The earphone of claim 7, wherein the high-frequency driver is a balanced-armature type, a moving-coil type, a moving-magnet type, or a piezoelectric type.

10. The earphone of claim 7, wherein the casing includes a front shell and a rear shell assembled to each other, with the front shell having the sound-guiding portion and the rear shell defining a via hole, so that the low- and high-frequency drivers are connected electrically to a circuit board through the via hole.

* * * * *